United States Patent [19]

Litz

[11] 3,994,234

[45] Nov. 30, 1976

[54] PROJECTILE

[75] Inventor: Charles J. Litz, Cinnaminson, N.J.

[73] Assignee: The United States of America as represented by the Secretary of the Army, Washington, D.C.

[22] Filed: Mar. 7, 1975

[21] Appl. No.: 556,528

[52] U.S. Cl. ..... 102/90; 102/6; 102/66; 102/87

[51] Int. Cl.[2] ..... F42B 11/24

[58] Field of Search ..... 102/6, 66, 60, 87, 70.2, 102/78, 90

[56] References Cited

UNITED STATES PATENTS

| | | | |
|---|---|---|---|
| 1,376,316 | 4/1921 | Chilowsky | 102/87 |
| 1,450,579 | 3/1923 | Chilowsky | 102/90 X |
| 2,419,828 | 4/1947 | Ferres | 102/78 |
| 2,420,028 | 5/1947 | Bleakney et al. | 102/70.2 X |
| 2,498,040 | 2/1950 | Jordan et al. | 102/78 X |
| 2,721,913 | 10/1955 | Kent, Jr. | 102/70.2 R |
| 3,345,948 | 11/1967 | Sarvis | 102/87 |
| 3,657,500 | 3/1972 | Gawlick | 102/70.2 R |
| 3,776,140 | 12/1973 | Jones | 102/78 |

FOREIGN PATENTS OR APPLICATIONS

| | | | |
|---|---|---|---|
| 147,104 | 6/1921 | United Kingdom | 102/66 |

*Primary Examiner*—Harold Tudor
*Attorney, Agent, or Firm*—Nathan Edelberg

[57] ABSTRACT

A projectile in which the drag effect on its external surface is minimized during operational flight. The tapered projectile nose has peripheral port means in the tapered external surface and in fluid communication with a propellant chamber secured within the nose portion. An electrical ignition element ignites the propellant during projectile flight to eject pressurized gas out of the port means into an environmental air stream.

6 Claims, 3 Drawing Figures

PROJECTILE

The invention described herein may be manufactured, used and licensed by or for the Government for governmental purposes without the payment to me of any royalty thereon.

In the past, means have been sought for ballistically launched aerodynamic projectiles in air or water to reduce drag, increase target accuracy, and reduce time of flight. Various passive aerodynamic means as designing more streamline projectiles or sloping boat tail sections have been proposed to individually accomplish one of these objectives.

It is an object of the invention to provide a projectile having internally developed ported gas means for minimizing the effect of drag on its external surface during operational flight.

Another object of the invention is to provide such a projectile having increased accuracy.

A further object of the invention is to provide such a projectile having a predictable reduced time of flight and reduced propellant charge requirement in its launcher.

These and other objects, features and advantages will become more apparent from the following description and accompanying drawings in which.

Figure 1:
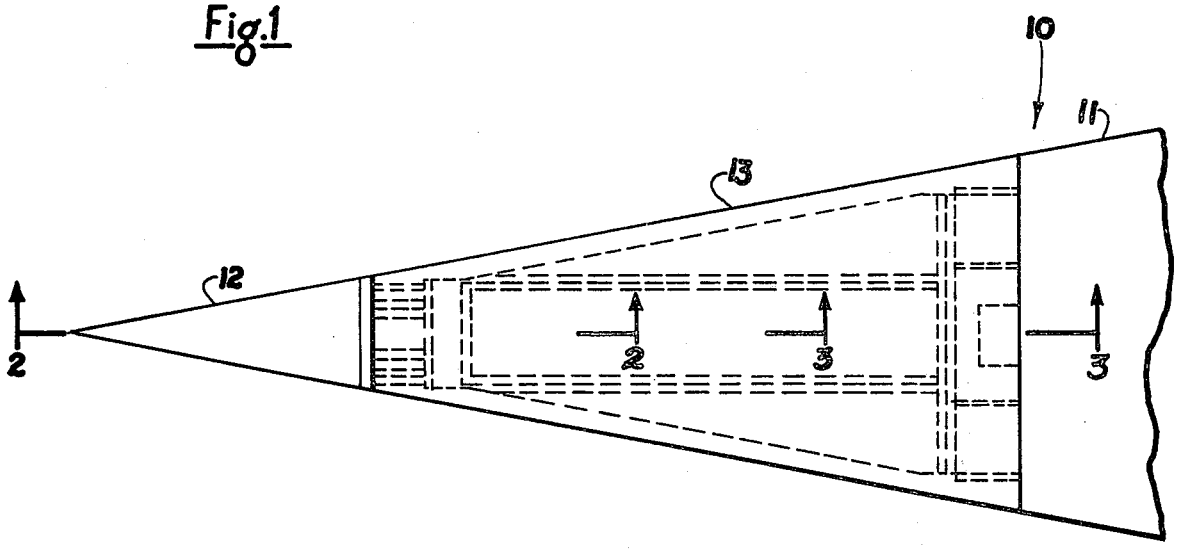
FIG. 1 is a side elevational view partially broken away, of a projectile embodying the principles of the invention.
Figure 2:
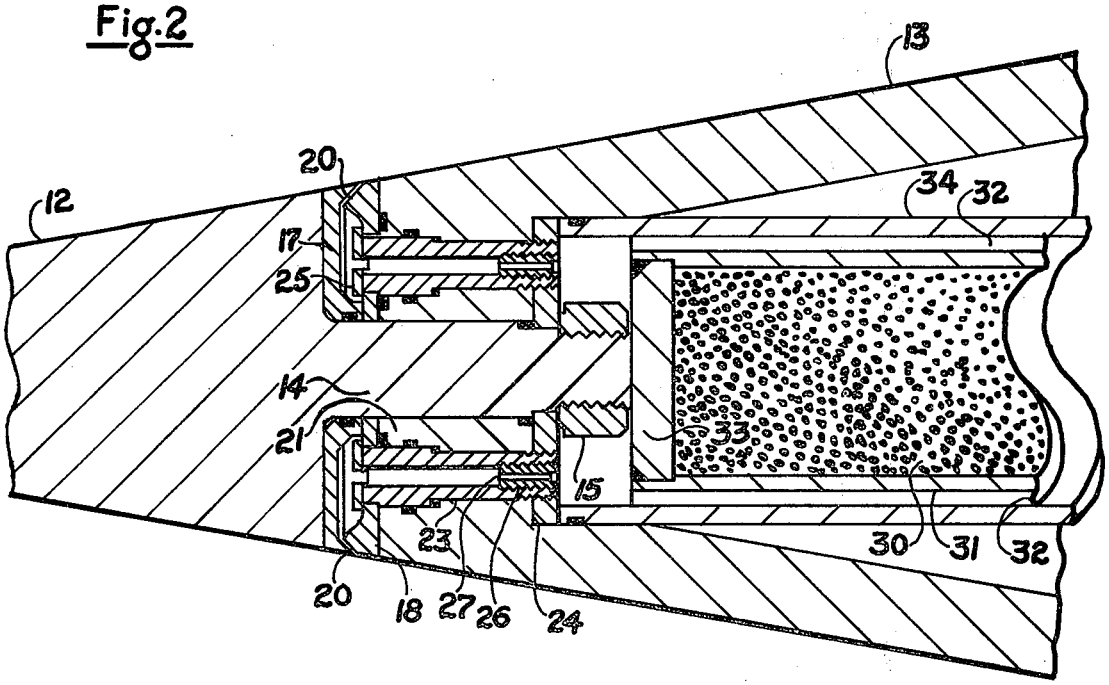
FIG. 2 is an enlarged sectional view, partially broken away, taken along line 2—2 of FIG. 1.

The projectile, shown generally at 10 (FIG. 1), has a main body portion 11, preferably carrying a pay-load (not shown), and threadedly secured thereto a forward nose portion having a forwardmost conical tip portion 12 and a tapered hollow portion 13. The external surfaces of nose portions 12 and 13 have a continuous conical taper, and nose portion 12 is a metallic member having a rearwardly extending central protuberance or stub 14 (FIG. 2). Stub 14 has a threaded rearward end portion to accommodate nut 15 that secures hollow nose portion 13 to nose tip member 12, as will be described.

Figure 3:
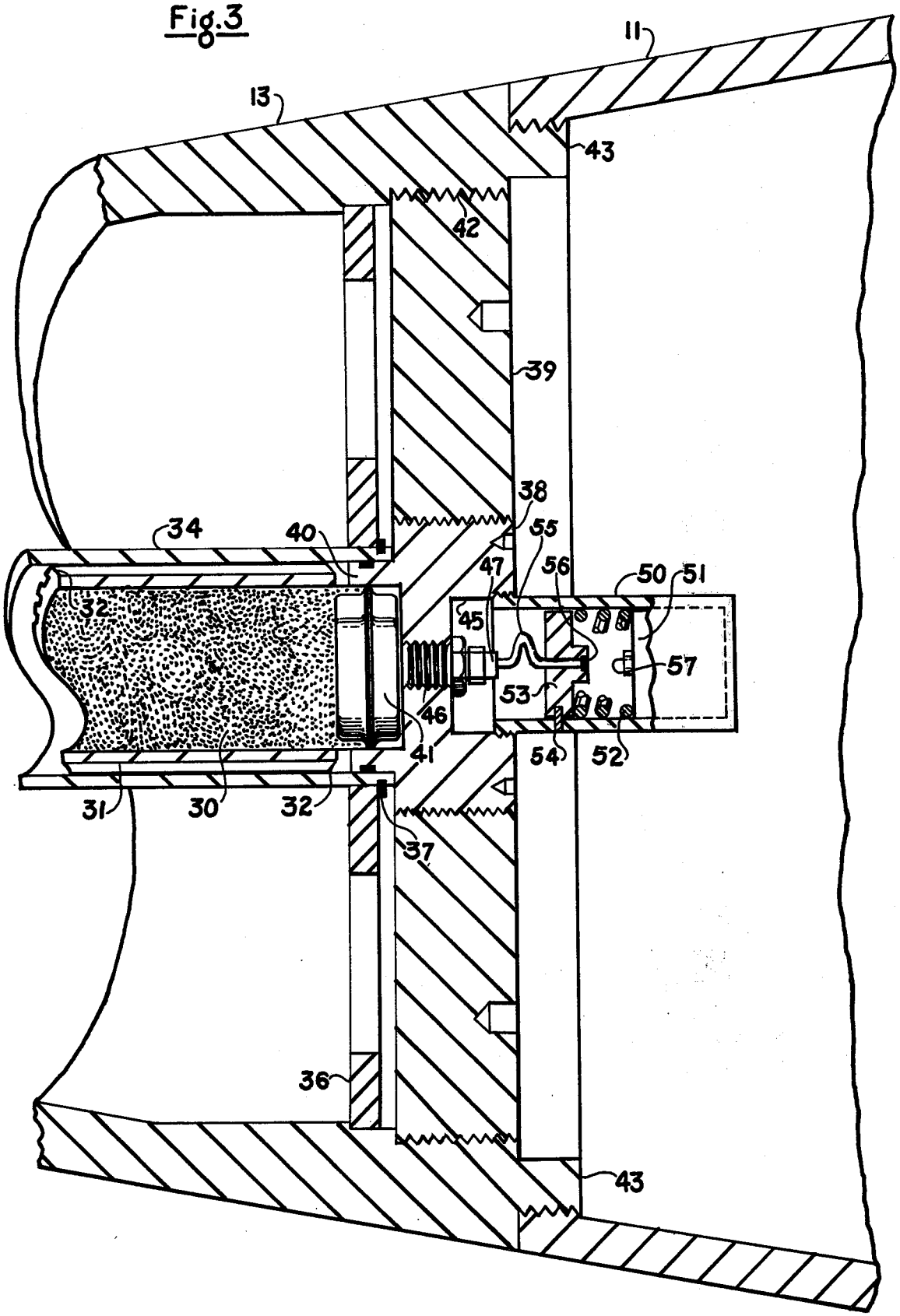
FIG. 3 is an enlarged sectional view, partially broken away, taken along 3—3 of FIG. 1.

Preferably, a mating pair of annular plate members 17, 18 are of predetermined size and shape to define therebetween an annular gas exit port 20 when the plates 17, 18 are secured in position on stub 14. The peripheral plate surface portions defining annular port 20 are rearwardly inclined to form an acute angle of revolution with the longitudinal axis of the projectile. The inwardly directed annular flange 21 on the forward end of nose hollow portion 13, which is slid on stub 14 upon assembly, contains a plurality (preferably 4) of circumferentially spaced orifice tubes 23 that are threadedly secured in tapped openings in retainer plate 24 for assembly with plate 18 which has suitable openings to receive the headed end 25 of the respective orifice tubes. Each headed end 25 is slotted to facilitate use of a screw driver during assembly, and each tube 23 carries at its rearward end a threaded insert 26 having a longitudinal passage 27 therethrough of predetermined size and which is in fluid communication with both the annular gas port 20 and the rearmost ignitable burning surface of cigarette type or stick propellant 30 (FIGS. 2,3). The stick propellant 30 is suitably mounted in a substantially cylindrical by-pass case 31 that is provided with circumferentially spaced longitudinal ribs 32, 32 on its external side wall and an end closure 33 welded to its forward end. The by-case 31 is slidingly mounted within cylindrical retaining tube 34 which in turn is slidingly mounted against retainer plate 24 in the forward end of nose hollow portion 13.

A centering spider plate 36 supports the rearward end of retaining tube 34 in the desired central position and is secured in place by retaining ring 37. A retainer plug 38, threadedly secured within an annular base plate 39, has a forward cylindrical protrusion 40 containing igniter 41 and slidingly mounted in the rearmost end of retaining tube 34. Base plate 39 is threadedly secured in a rearmost internally threaded surface 42 on nose hollow portion 13, adjacent the forward end of projectile main body portion 11 which is threadedly secured to the nose portion externally threaded rearwardly protruding annulus 43.

Retainer plug 38 has a central rearwardly opening recess 45, the base of which has a tapped central hole 46 intersecting the igniter cavity and in which an electrical ignition element 47 is secured. Threadedly secured in the rearmost sidewall portion of plug recess 45, is a forwardly opening cylindrical case 50 housing electrical battery 51 that is biased by compression spring 52 against the closed end of the battery case and away from an annular contact plate 53. Contact plate 53 is formed of inert material and initially secured against longitudinal movement by shear pin 54. A coil of an insulated electric wire 55 has one end connected to ignition element 47 and the other end extends through a central passage in contact plate 53 to which it is connected by epoxy cement at a rearmost contact point 56.

Wire contact 56 is adapted, upon the effect of projectile launching set back forces that cause the compression of spring 52, to make contact with battery contact 57 to close the electrical power supply circuit and actuate ignition element 47. Thereupon the burning of igniter 41 will ignite the rearward surface of propellant stick 30, and the developed pressure gas will flow past by-pass case ribs 32, through the orifice tubes 23, and out annular gas port 20 to flow rearward substantially along the external surface of nose portion 13. This causes the environmental air boundary layer to remain laminar rather than turbulent, thereby reducing the skin friction drag effect on the projectile.

Various modifications, alterations or changes may be resorted to without departing from the scope of the invention as defined in the appended claims.

I claim:

1. In a projectile having a main body portion and a forward nose portion secured thereto, said nose portion having a conical tip and a tapered hollow portion, a retaining tube in said tapered hollow portion, a cylindrical by-pass case in said retaining tube and having an external sidewall containing a plurality of circumferentially spaced longitudinal ribs, a rearward end burning stick propellant in said by-pass case, annular plate means intermediate said tapered hollow portion and said conical tip and having tapered external surface means cooperating therewith to define a continuous conical taper, port means in said annular plate means and in fluid communication with said longitudinal ribs and said stick propellant, and igniting means positioned to the rear of said stick propellant for igniting said stick propellant at said rearward end during flight of said projectile to eject pressurized gas forwardly past said spaced longitudinal ribs and out of said port means into an environmental air stream and thereby minimize the drag effect on the projectile rearward of said port means.

2. The structure in accordance with claim 1 wherein said igniting means includes an electrical battery secured in a battery case, said battery case and an ignition element secured to a common support plate extending across said nose portion of said projectile, a contact plate slidably mounted in said battery case and having contact means adapted to contact said battery, a shear pin initially securing said contact plate to said battery case, electric wire means interconnecting said ignition element and said contact means, and a compression spring extending between said contact plate and said battery.

3. The structure of claim 1 wherein said nose conical tip portion has a rearwardly protruding central stub, said nose hollow portion has a forward inwardly directed annular flange through which said stub extends, and means on said stub securing said nose hollow portion to said tip portion.

4. The structure of claim 3 wherein said annular plate means are mounted on said stub and contain an annular peripheral opening to define said port means.

5. The structure of claim 4 wherein a plurality of passageways in said flange are in fluid communication with said annular peripheral opening and said stick propellant, said passageways including circumferentially spaced orifice tubes, each of said orifice tubes carrying a threaded insert, said insert having a longitudinal passage therethrough.

6. The structure of claim 4 wherein said plate means includes port defining peripheral surface portions having rearward inclinations to form an acute angle of revolution with the longitudinal axis of said projectile.

* * * * *